US007494200B2

(12) United States Patent
Chikuma et al.

(10) Patent No.: US 7,494,200 B2
(45) Date of Patent: Feb. 24, 2009

(54) RECORDING APPARATUS AND RECOVERY CONTROL METHOD

(75) Inventors: Toshiyuki Chikuma, Kawasaki (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 11/062,590

(22) Filed: Feb. 23, 2005

(65) Prior Publication Data

US 2005/0190219 A1 Sep. 1, 2005

(30) Foreign Application Priority Data

Feb. 27, 2004 (JP) ..... 2004-053237

(51) Int. Cl.
*B41J 29/38* (2006.01)

(52) U.S. Cl. ..... 347/9

(58) Field of Classification Search ..... 347/22, 347/5, 6, 9, 19
See application file for complete search history.

(56) References Cited

U.S. PATENT DOCUMENTS 3,925,789 A * 12/1975 Kashio ..... 347/23
5,850,237 A * 12/1998 Slade ..... 347/23
6,796,633 B1 * 9/2004 Kawamata et al. ..... 347/23
2002/0070991 A1 * 6/2002 Otsuki ..... 347/16
2003/0002056 A1 * 1/2003 Yamaguchi et al. ..... 358/1.2
2003/0184608 A1 * 10/2003 Masuyama et al. ..... 347/12

FOREIGN PATENT DOCUMENTS

JP 09-201984 8/1997
JP 2001205823 A * 7/2001

* cited by examiner

*Primary Examiner*—Hai C Pham
(74) *Attorney, Agent, or Firm*—Fitzpatrick, Cella, Harper & Scinto

(57) ABSTRACT

A control method at the time of preliminary ejection of ink is changed between a recording area in which a nozzle used for recording is not switched every recording scanning and a recording area in which the nozzle for recording is switched every recording scanning, whereby the preliminary ejection is performed at an appropriate frequency in any recording area.

20 Claims, 11 Drawing Sheets

RECORDING APPARATUS AND RECOVERY CONTROL METHOD

FIELD OF THE INVENTION AND RELATED ART

The present invention relates to a recording apparatus and a preliminary ejection control method and particularly relates to a recording apparatus for effecting recording with a recording head and a refreshing control method.

In recent years, in step with a proliferation of personal computers, word processors, facsimile apparatuses, etc., for use in office and at home, printers of various recording modes have been developed as information output equipment for such apparatuses. Of these equipment, ink jet-type printers are most suitable for office use or personal use at home because of many advantages, e.g., that it is readily adaptable to color recording and has low noise during operation and that it is capable of effecting high-quality recording on various recording materials and has a small size. Of these ink jet printers, a serial scanning-type ink-jet recording apparatus for effecting recording on a recording material while performing reciprocating scanning the recording material with a recording head has widely been popularized in the market since it is capable of printing a high-quality image at low cost.

In the ink jet recording apparatus, a recording head of the ink jet-type effects recording by ejecting ink droplet held in a nozzle through a minute orifice (hereinafter, referred to as an "ejection outlet") toward the recording material. At this time, in the recording head, an amount of ink in the nozzle is decreased by ejecting the ink from the nozzle and fresh ink is supplied from an ink chamber and filled in the nozzle by capillary action.

In the case where ink ejection is not performed for a long period of time, moisture or a solvent of the ink is evaporated to precipitate a coloring material and the precipitated coloring material is formed into a film to prevent normal ink ejection. For this reason, kinetic energy generated by ejecting the ink droplet through a recording operation of the recording head is consumed for breaking the film, so that the ink droplet cannot have a sufficient ejection speed. As a result, the ink droplet cannot reach a desired position on the recording material.

For this reason, in order to prevent an occurrence of recording failure due to evaporation of moisture or a solvent of ink, the recording apparatus is required to move the recording head to the outside of the recording material within such a period that a sufficient film is not formed at ejection outlets and eject the ink at the position (hereinafter, this ejection is referred to as a "preliminary ejection") to be kept in such a condition that ejection outlets permit normal ink ejection during recording.

In this regard, a serial scanning-type recording apparatus as described in Japanese Laid-Open Patent Application No. HEI 09-201984 performs such control that it judges as to whether or not a predetermined time or above has elapsed from previous preliminary ejection when a carriage on which a recording head is mounted is turned during reciprocating scanning therewith, and when the predetermined time or above has elapsed, the recording head is mounted outside a recording material to effect preliminary ejection thereat.

However, by effecting such preliminary ejection, an ink ejection state from the recording head becomes better but when an operation of preliminary ejection is frequently performed, a lowering in recording speed (throughput) is caused to occur. Further, ink consumption by the preliminary ejection leads to an increase in running cost.

In order to solve such problems, there has been proposed such a control method that judgement as to whether or not a number of ejection of ink ejected from each of a plurality of ejection outlets of a recording head in a predetermined period of time is made and on the basis of a result of the judgement, a recordable time is compared with a time required for a subsequent recording scanning, and then preliminary ejection is performed when the recordable time is shorter than the time required for the subsequent recording scanning. Incidentally, such control that efficient preliminary ejection is controlled by counting (monitoring) the ejection number of ink ejected from each of the ejection outlets is referred to as "nozzle monitoring control".

However, in such a conventional recording area that a feeding rate of a recording material at the time of recording is constant and a certain number of nozzles for recording is used in each of respective recording scannings, appropriate preliminary ejection is performed by controlling the preliminary ejection on the basis of frequency in use of each of the nozzles as described above. However, when the feeding rate of the recording material at the time of recording is not constant or when nozzle(s) used for recording is switched for each recording scanning to change the number of nozzles for each recording scanning, preliminary ejection is performed also with respect to nozzles which are not used for recording. Accordingly, efficient preliminary ejection cannot be performed by the above-described control in some cases.

More specifically, for example, when an image is recorded by covering the entire surface of a recording material so as not to leave a margin of the recording material (such a recording method is also referred to as "frame-less recording"), a feeding accuracy of the recording material is decreased at both end portions of the recording material in a feeding direction of the recording material. For this reason, a feeding rate at that time is lowered compared with an ordinary feeding rate and a recording operation is performed by using only a part of nozzles of a recording head. During recording at both end portions of the recording material, the feeding rate of the recording material and nozzles used for recording thereat are not constant in many cases. Accordingly, during recording at both end portions in the feeding direction of the recording material, nozzles are different between a previous recording scanning and a (current) recording scanning subsequent to the previous recording scanning in some cases. For this reason, in the above-described control method for controlling the preliminary ejection depending on frequency in use of nozzles used for ejection in recording scanning, after the preliminary ejection operation is performed, nozzles used for a subsequent recording scanning are switched. As a result, nozzles newly set as those for use in recording scanning are not placed in such a state that they normally eject ink in some cases. Further, in the above-described control method, in the case where such a constitution that preliminary ejection is controlled depending on frequency in use of nozzles used for recording is employed, all the nozzles have not necessarily been subjected to preliminary ejection. As a result, a preliminary ejection operation is always performed for each recording scanning. In the control method described above, there is a possibility that necessary preliminary ejection is not performed or preliminary ejection is performed more than necessary, thus failing to perform an appropriate preliminary ejection operation.

Further, in order to comply with switching of nozzles used in recording scanning, in the case where all nozzles which have a possibility that they are used in the same page (sheet of a recording material) are subjected to counting by a nozzle counter, preliminary ejection is performed also with respect to nozzles, which are not used for recording for each recording area, so as to permit normal ink ejection when judgement as to whether the preliminary ejection is performed or not in made. For this reason, the recording apparatus is placed in such a state that the preliminary ejection operation is performed most frequently within one page (sheet), so that the nozzle monitor control does not function substantially.

SUMMARY OF THE INVENTION

In view of the above described problems, an object of the present invention is to provide a recording apparatus capable of effecting such a control that appropriate preliminary ejection is performed most efficiently even when nozzles used in recording scanning are changed.

Another object of the present invention is to provide a maintenance method for a recording head used in the recording apparatus.

According to an aspect of the present invention, there is provided a recording apparatus for effecting recording on a recording material by scanning the recording material with a recording head for ejecting ink from a plurality of nozzles, comprising:

feeding means for feeding the recording material, discrimination means for discriminating a recording area for effecting recording on the recording material, preliminary ejection means for ejecting ink, which is not contributable to image recording, from each of the plurality of nozzles, and preliminary ejection control means for controlling the preliminary ejection means so that either one of first preliminary ejection for performing preliminary ejection on the basis of the number of ejections of ink ejected from each of the plurality of nozzles and second preliminary ejection for performing preliminary ejection on the basis of an elapsed time from previous preliminary ejection is performed on the basis of a discrimination result by the discrimination means.

According to another aspect of the present invention, there is provided a preliminary ejection control method in a recording apparatus of the type wherein the recording apparatus comprises a recording head for ejecting ink from a plurality of nozzles and preliminary ejection means for ejecting ink, which is not contributable to image recording, from each of the plurality of nozzles, and effects recording on a recording material by scanning the recording material with the recording head; the method comprising:

a discrimination step for discriminating a recording area for effecting recording on the recording material, and a preliminary ejection control step for controlling the preliminary ejection means so that either one of first preliminary ejection for performing preliminary ejection on the basis of the number of ejections of ink ejected from each of the plurality of nozzles and second preliminary ejection for performing preliminary ejection on the basis of an elapsed time from previous preliminary ejection is performed on the basis of a discrimination result in the discrimination step.

According to the present invention, by changing control at the time of performing preliminary ejection between an ordinary recording area in which nozzles used for recording are not switched and another recording area in which nozzles used for recording are switched, it becomes possible to perform the preliminary ejection at an appropriate frequency in any recording area. Further, the preliminary ejection is performed efficiently, so that throughput at the time of recording is improved to reduce ink consumption by the preliminary ejection.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First Embodiment

Hereinbelow, embodiments of the present invention will be described with reference to the drawings.

In the following embodiments, a recording apparatus using an ink jet-type recording head will be explained as an example of the recording apparatus according to the present invention.

Incidentally, herein, "recording" (also referred to as "print") represents not only formation of significant information such as characters, graphics, or the like but also formation of an image, a pattern, or the like on a recording material or processing of the recording material, irrespective of significance or insignificance and of whether or not resultant information is visualized so as to be visually perceived by a person.

A "recording material" represents not only paper used in an ordinary recording area but also other ink-receivable materials such as cloth, plastic films, metal plates, glass, ceramics, wood, leather, etc.

Further, "ink" (also referred to as "liquid") should be broadly interpreted similarly as in the case of "recording (print)" described above and represents liquid capable of being subjected to formation of an image, a pattern, or the like; processing of a recording material; or treatment of ink (e.g., solidification or insolubilization of a coloring material in ink provided to a recording material) by providing it onto a recording material.

Further, a "nozzle" (also referred to as a "recording element" represents inclusively an ejection outlet, a liquid passage communicating with the ejection outlet, a liquid passage communicating with the ejection outlet, and an element for generating energy utilized for ink ejection.

Figure 1:
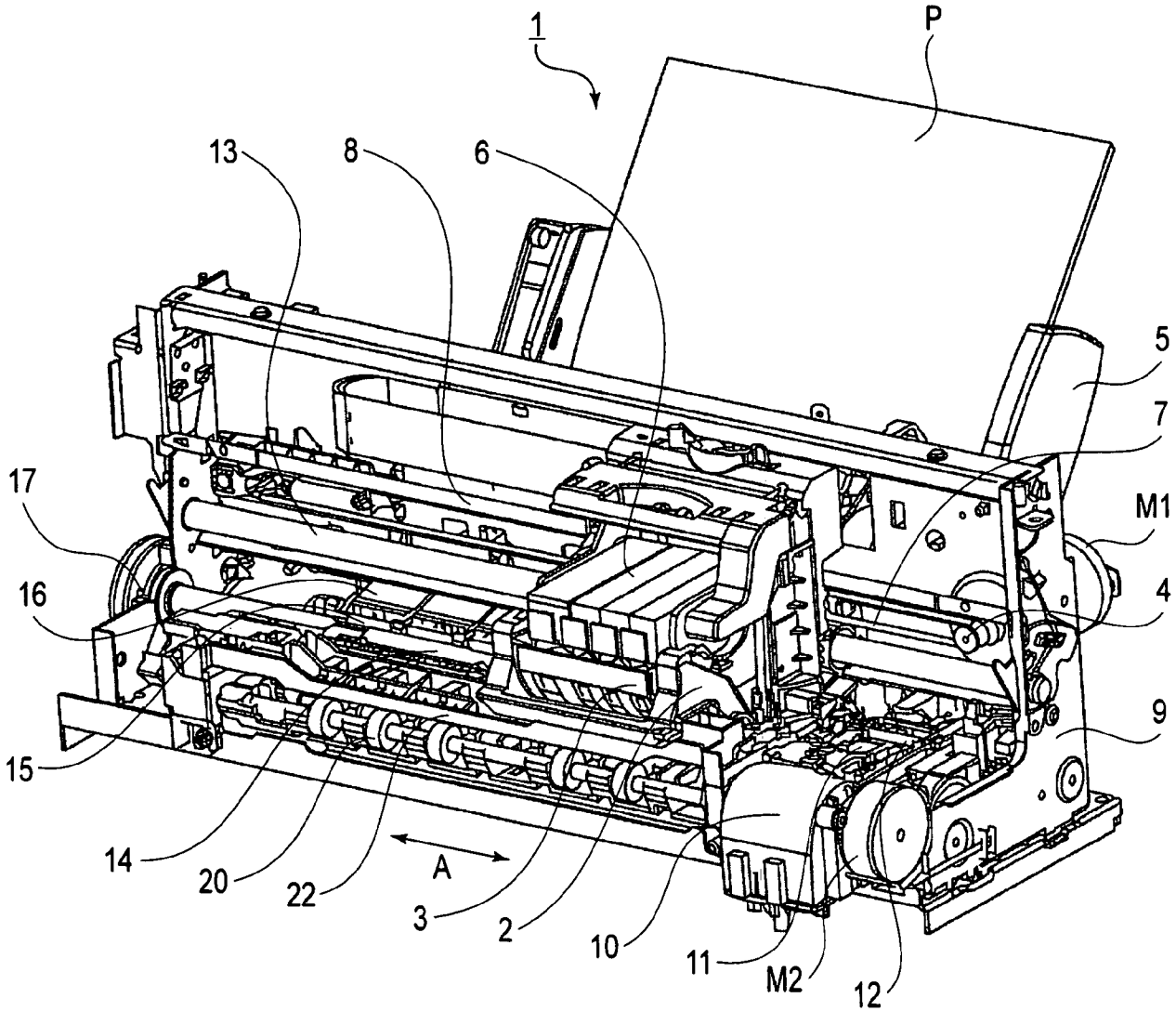
FIG. 1 is a schematic perspective view showing a general structure of an ink jet recording apparatus as a representative embodiment of the present invention.

Description of Ink Jet Recording Apparatus (FIG. 1)

FIG. 1 is an external perspective view showing a general structure of an ink jet recording apparatus 1 as a representative embodiment of the present invention.

As shown in FIG. 1, in the ink jet recording apparatus 1, a driving force generated by a carriage motor M1 is transmitted through a transmission mechanism 4 to a carriage 2 on which a recording head 3 for effecting recording by ejecting ink therefrom in accordance with an ink jet scheme is mounted, whereby the carriage 2 is put into reciprocating motion in a double-printed arrow A. At the same time, a recording material P such as recording paper is fed to a recording position through a feeding mechanism 5 and at the recording position, recording is performed by ejecting ink from the recording head 3 onto the recording material P.

Further, in order to keep a condition of the recording head 3 good, the carriage 2 is moved to a position of a recovery unit 10 and at the position, ejection recovery treatment of the recording head 3 is performed intermittently.

On the carriage 2 of the recording apparatus 1, not only the recording material 3 is mounted but also an ink cartridge 6 for storing ink to be supplied to the recording head 3 is mounted. The ink cartridge 6 is detachably mountable to the carriage 2.

The recording apparatus 1 shown in FIG. 1 is capable of effecting color recording. For that purpose, four ink cartridges for accommodating inks of magenta (M), cyan (C), yellow (Y) and black (K), respectively, are mounted on the carriage 2. These ink cartridges are independently detachably mountable to the carriage 2.

The carriage 2 and the recording head 3 are designed so that contact surfaces of these members come into contact with each other properly to ensure and retain desired electrical connection therebetween. The recording head 3 is supplied with energy depending on a recording signal, whereby it ejects ink selectively from a plurality of ejection outlets to effect recording. Particularly, the recording head 3 used in this embodiment employs such an ink jet scheme that ink is ejected by utilizing thermal energy and is provided with an electrothermal energy conversion element for generating thermal energy. Electric energy applied to the electrothermal energy conversion element is converted into thermal energy. The thermal energy is provided to ink to cause film boiling, whereby a change in pressure is caused by growth (expansion) and contraction of bubble is utilized to eject ink from an ejection outlet. The electrothermal energy conversion element is provided in correspondence with each of the ejection outlets, so that ink is ejected from a corresponding ejection outlet by applying a pulse voltage to an associated electrothermal energy conversion element on the basis of a recording signal.

As shown in FIG. 1, the carriage 2 is connected to a part of a driving belt 7 of the transmission mechanism 4 for transmitting the driving force from the carriage motor M1 and is slidably supported along a guide shaft 13 in the direction of the arrow A. Accordingly, the carriage 2 performs reciprocating motion along the guide shaft 13 by normal rotation and reverse rotation of the carriage motor M1. Further, in a movement direction (the arrow A direction shown in FIG. 1 and is also referred to as a "main scan direction"), the recording apparatus 1 is provided with a scale 8 for indicating an absolute position of the carriage 2. In this embodiment, the scale 8 is formed of a transparent PET film on which black bars are printed at a necessary pitch. At one end, the scale 8 is fixed to a chassis 9 and at the other end, the scale 8 is supported by a plate spring (not shown).

Further, the recording apparatus 1 is provided with a platen (not shown) disposed opposite to an ejection surface, of the recording head 3, at which the ejection outlets (not shown) are formed. Concurrently with the reciprocating motion of the carriage 2, on which the recording head 3 is mounted, by the driving force from the carriage motor M1, ink is ejected by supplying a recording signal to the recording head 3. As a result, recording is performed over a full width of the recording material P feed onto the platen.

In FIG. 1, the recording apparatus 1 further includes a feeding roller 14, for conveying the recording material P, driven by a feeding motor M2; a pinch roller 15 for causing the recording material P to contact the feeding roller 14 by a spring (not shown); a pinch roller holder 16 for rotatably supporting the pinch roller 15; and a feeding roller gear 17 disposed fixedly at one end of the feeding roller 14. The feeding roller 14 is driven by a rotational force transmitted from the feeding motor M2 to the feeding roller gear 17 via an intermediary gear (not shown).

A discharge roller 20 for discharging the recording material P, on which an image is formed by the recording head 3, to the outside of the recording apparatus 1 is driven by transmitting the rotational force from the feeding motor M2 to the discharge roller 20. The discharge roller 20 is caused to contact the recording material P by a spur roller (not shown) which presses the recording material P against the discharge roller 20 by a spring (not shown). The spur roller is rotatably supported by a spur holder 22.

Further, as shown in FIG. 1, the recording area 1 is provided with a refreshing unit 10, for refreshing ink so as to prevent ejection failure, disposed at a desired position (e.g., a position corresponding to a home position) outside a range (recording area) of the reciprocating motion for a recording operation of the carriage 2 on which the recording head 3 is mounted.

The recovery unit 10 is provided with a capping mechanism 11 for capping an ejection outlet surface of the recording head 3 and a wiping mechanism 12 for wiping (cleaning) the ejection outlet surface of the recording head 3. In synchronism with the capping of the ejection outlet surface by the capping mechanism 11, the ink is forcedly discharged from the ejection outlet by suction means (suction pump etc.) in the recovery unit 10, whereby an ejection recovery treatment such that ink increased in viscosity in an ink path of the recording head 3, bubbles, and the like are removed is performed.

During a non-recording operation or the like, the ejection outlet surface of the recording head 3 is capped by the capping mechanism 11, whereby it is possible to protect the recording head 3 and prevent evaporation or drying of ink. On the other hand, the wiping mechanism 12 is disposed close to the capping mechanism 11 so as to wipe the ink droplet attached to the ejection outlet surface of the recording head 3.

By these capping mechanism 11 and wiping mechanism 12, it becomes possible to keep an ink ejection condition of the recording head 3 normally.

Figure 2:
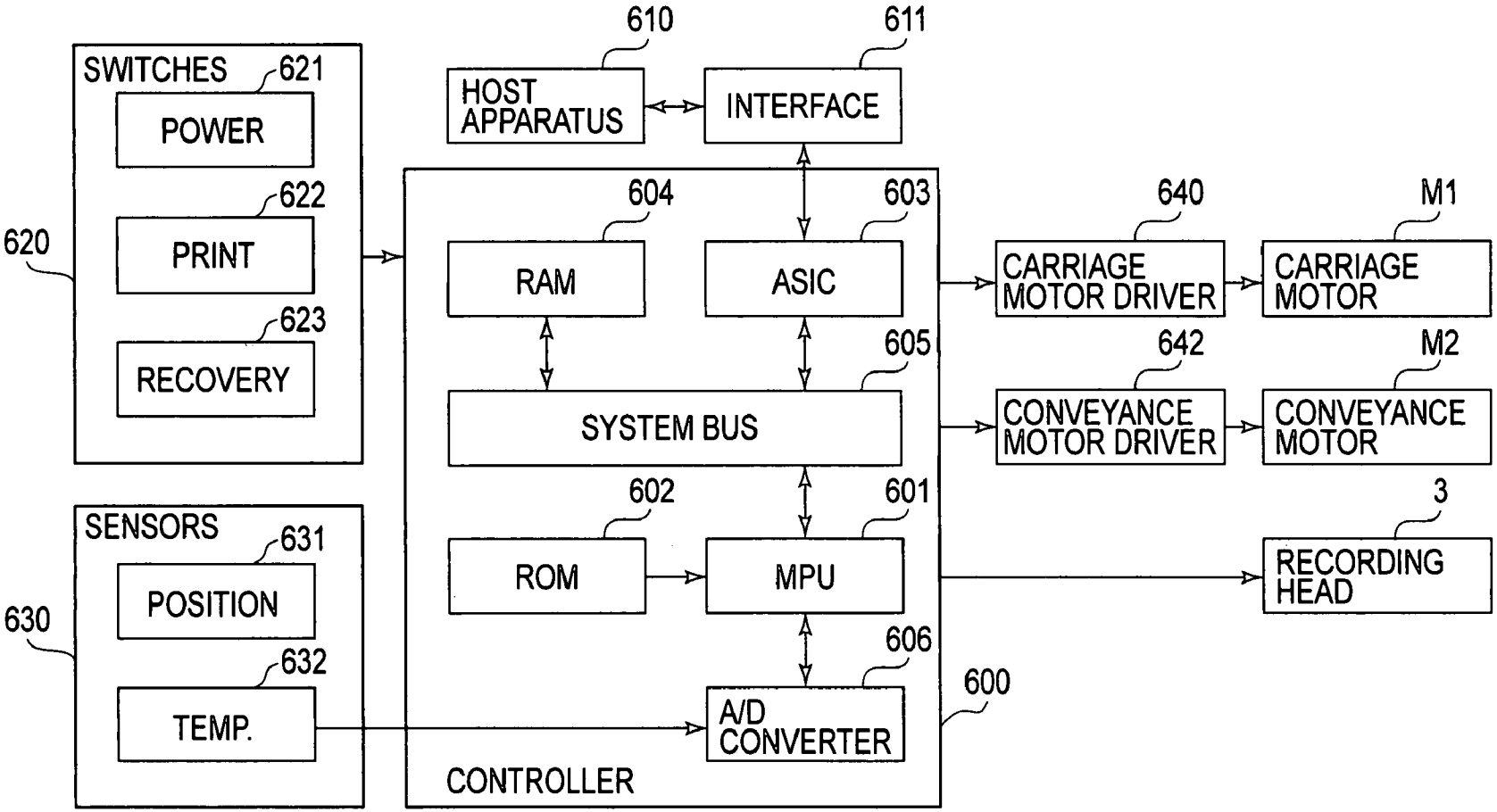
FIG. 2 is a block diagram showing a constitution of a control circuit of the ink jet recording apparatus shown in FIG. 1.

Control Constitution of Ink Jet Recording Apparatus (FIG. 2)

FIG. 2 is a block diagram showing a constitution of control of the recording apparatus shown in FIG. 1.

As shown in FIG. 2, a controller 600 is constituted by an MPU 601; an ROM 602 in which a program corresponding to a control sequence described later, a necessary table, and other fixed data are stored; an application-specific integrated circuit (ASIC) 603 for generating control signals for controlling a carriage motor M1, a feeding motor M2, and a recording head 3; an RAM 604 provided with an expanding area for image data and a work area for executing a program; a system bus, for transmitting and receiving data, mutually connected with the MPU 601, the ASIC 603, and the RAM 604; and an A/D converter for effecting A/D conversion by inputting an analog signal from sensors described later and supplying a resultant digital signal to the MPU 601.

Further, in FIG. 2, a computer 610 (or a reader for image reading, a digital camera, etc.) as a supply source of the image data is generically called a host apparatus. Between the host apparatus 610 and the recording apparatus 1, the image data, commands, status signals, and the like are transmitted and received through an interface (I/F) 611.

Switches 601 are constituted by those for receiving instruction input by an operator, such as a power switch 621, a print switch 622 for instructing print start, a recovery switch 623 for instructing start of a (recovery) treatment for keeping an ink ejection performance of the recording head 3 in a good condition, etc. Sensors 630 for detecting an application condition are constituted by a position sensor 631, such as a photocoupler, for detecting the home position and a temperature sensor 632, disposed at an appropriate position of the recording apparatus 1, for detecting an environmental temperature.

The recording apparatus 1 further include a carriage motor driver 640 for driving the carriage motor M1 for putting the carriage 2 into reciprocating scanning in the direction of the arrow A (FIG. 1) and a feeding motor driver 642 for driving the feeding motor M2 for feeding the recording material M. The ASIC 603 transfers drive data (DATA) for a recording element (ejection heater) to the recording head 3 while directly accessing a storing area of the RAM 602 during the recording scanning by the recording head 3.

Based on the above described constitution, the ink jet recording apparatus stores image data, transferred from the host apparatus 610 via the interface 611, in the RAM 604 and converts the image data into recording data representing ink ejection information to store the recording data in the RAM 604. During the recording, ink is ejected from the recording head 3 on the basis of the recording data to form an image based on the image data.

Next, a relationship between a feeding rate of a recording material during recording and nozzle(s) used in recording scanning will be described.

Figure 3:
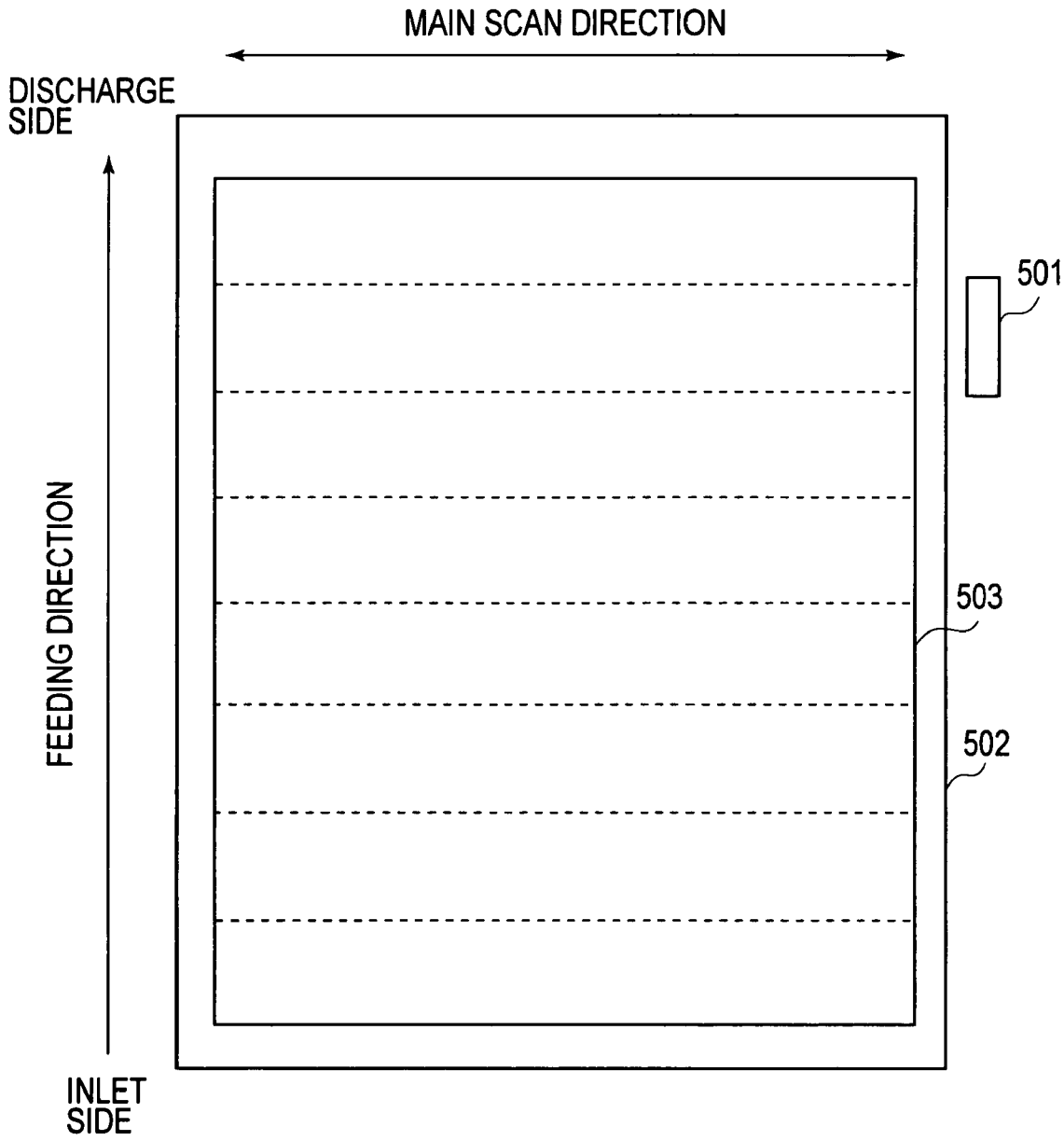
FIG. 3 is a schematic view showing a relationship between recording areas and nozzles of a recording head in a conventional recording apparatus.

FIG. 3 is a schematic view showing a relationship between a feeding rate and nozzle(s) used in recording scanning in a conventional recording apparatus.

Referring to FIG. 3, a recording head 501 is provided with a plurality of arranged nozzles (ejection outlets) for ejecting ink therefrom. On a recording material 502, a recording area 503 for recording an image therein is shown.

The recording head 501 ejects ink for recording from nozzles on the basis of image data while reciprocating-scanning the recording material 502 in a main scan direction, and the recording material 502 is fed from an inlet (paper-feeding) side to a discharge (paper-outlet) side in a feeding direction. An image is formed on the recording material 502 by repeating the recording scanning with the recording head 501 in the main scan direction and the feeding operation of the recording material 502 in the feeding direction. In the conventional recording apparatus, a feeding rate (or an amount of feeding) of the recording material 502 was kept constant in order to enhance a feeding accuracy of the recording material 502 and ink was ejected from all the nozzles, to be used during ordinary recording, for one recording scanning. In other words, a recordable range of the nozzles to be used during ordinary recording was set as the feeding rate of the recording material 502.

The feeding operation of the recording material 502 performed conventionally during the recording improves the feeding accuracy of the recording material 502 by being performed by the feeding and discharge rollers 14 shown in FIG. 1. Incidentally, the recording head 3 is located between the feeding and discharge rollers 14.

Next, switching of nozzles used for recording in recording scanning unit with respect to the nozzles of the recording head will be described with reference to FIGS. 4 to 7.

Herein, as an example of switching of nozzles, of the plurality of nozzles arranged in the recording head, used for recording in recording scanning unit, frame-less recording for forming an image in a recording area, corresponding to the entire surface of the recording material, set so as not to leave a margin of the recording material will be described.

Figure 4:
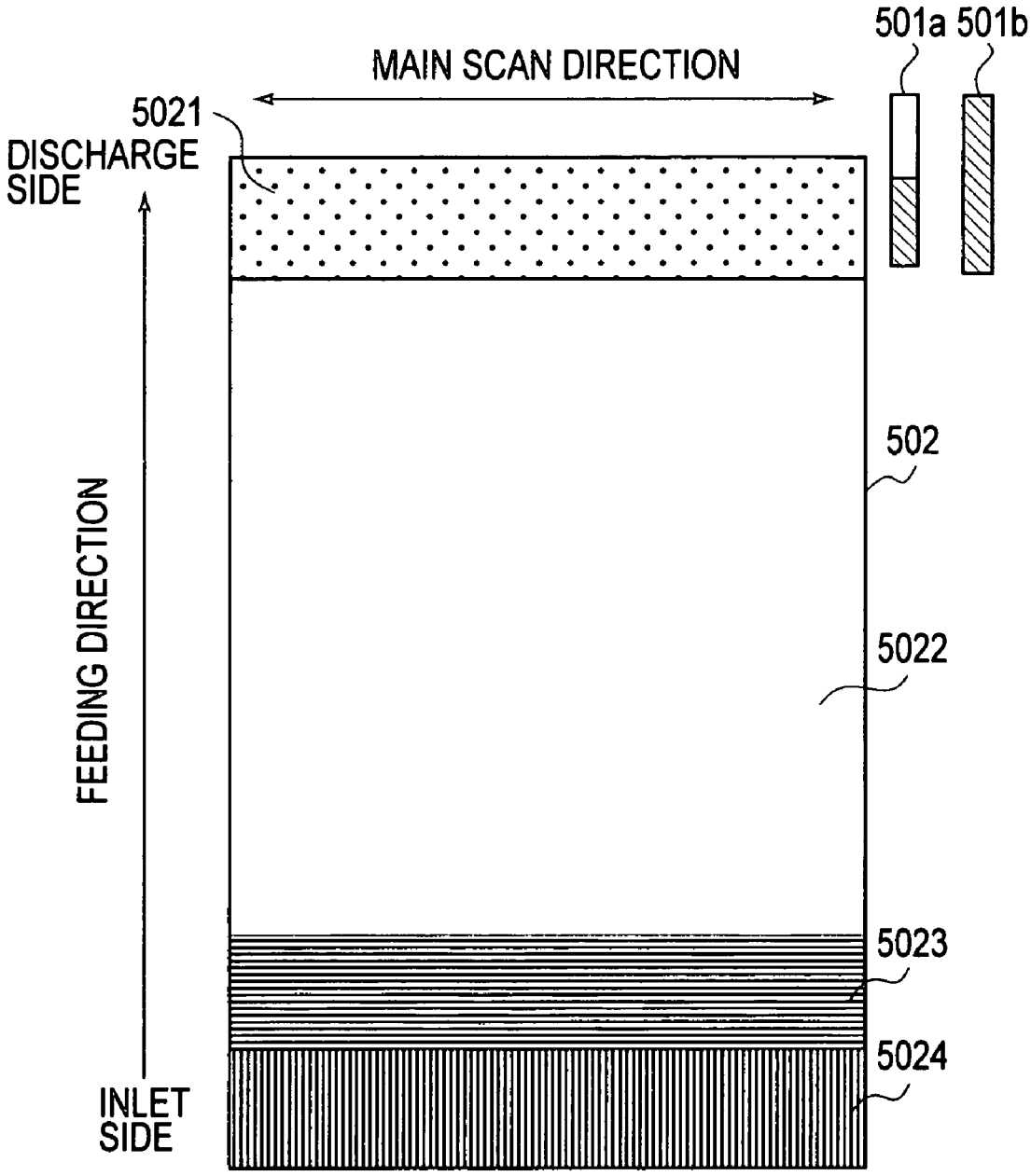
FIGS. 4 to 7 are schematic views each showing a relationship between recording areas and nozzles of a recording head in First Embodiment of the present invention.

FIG. 4 shows nozzles used for recording at a leading end portion of the recording material in the feeding direction.

Referring to FIG. 4, the recording material has a recording area 5021 (located at a leading end portion) on a downstream (discharge) side of the feeding direction of the recording material, a principal recording area 5022 corresponding to an ordinary recording area similarly as in the case of the conventional recording apparatus, a recording area 5024 (located at a trailing end portion) on an upstream (inlet) side of the feeding direction, and a recording area 5023 located between the ordinary recording area 5022 and the trailing end portion recording area 5024.

In the case of effecting recording in the leading end portion recording area 5021, when the recording material is, after being subjected to a feeding operation thereof, fed to the discharge (paper output) roller via a recording portion by the feeding roller, the feeding operation of the recording material is performed by using only the feeding roller without using the discharge roller. Accordingly, there is a possibility that the feeding accuracy is lowered. When the feeding accuracy is lowered, an unevenness or white streaks are generated in a resultant recording image, thus lowering an image quality. For this reason, in order to retain a predetermined feeding accuracy without lowering the feeding accuracy, the feeding rate of the recording material in the leading end portion recording area in which the feeding of the recording material is performed only by the feeding roller is set to be smaller than that in the ordinary recording area. As described above, the feeding rate of the recording material in the leading end portion recording area is small, so that a number of the nozzles used therein for recording scanning is also smaller than that used in the ordinary recording area.

Particularly, during the recording in the leading end portion recording area of the recording material, nozzles (indicated by hatched lines of a recording head 501*a* shown in FIG. 4), located on the upstream (inlet) side of the feeding direction, among the plurality of nozzles arranged in the recording head are used for recording. At this time, other nozzles of the recording head located or the downstream (discharge) side of the feeding direction are not used for recording. When the recording material feeding operation is performed by using both of the feeding roller and the discharge roller, the feeding rate is increased stepwise. At the same time, the number of nozzles used for recording is increased so that the feeding rate corresponds to a recording width corresponding to the nozzles used for recording. When the feeding rate is increased to such an extent that the recording is performed by a recording head 501*b*, recording in the ordinary recording area 5022 is performed. Incidentally, in FIGS. 4 to 7, nozzles, of all the nozzles arranged in the recording head, used in recording scanning are indicated by hatched lines.

Figure 5:
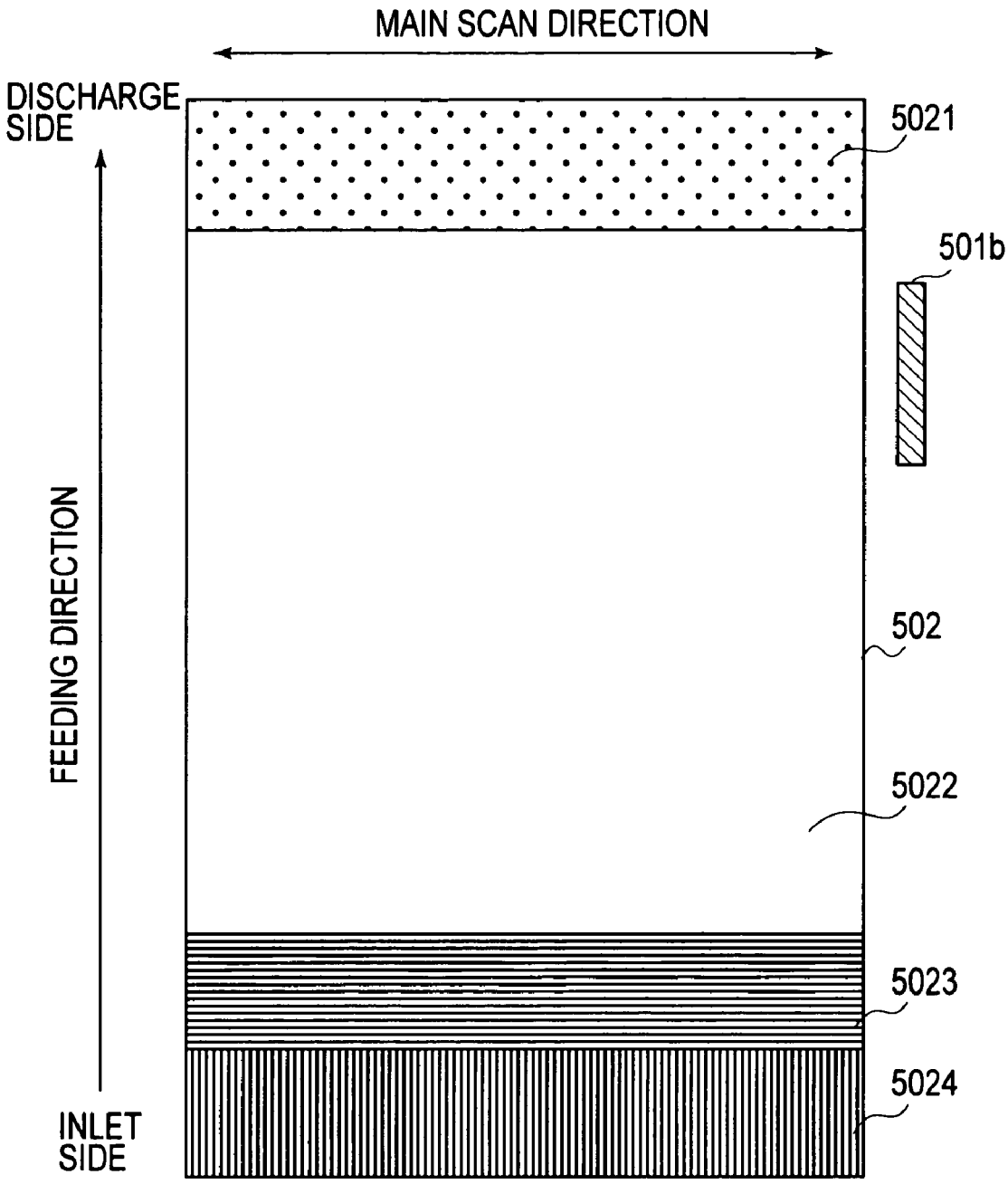

FIG. 5 shows nozzles used for recording in the ordinary recording area of the recording material. The recording in the ordinary recording area is performed in the same manner as in the conventional recording method. More specifically, the recording operation is performed by using all the nozzles of a recording head 501*b* used for ordinary recording, and the feeding operation is performed at the feeding rate corresponding to the recording width by the recording operation.

Figure 6:
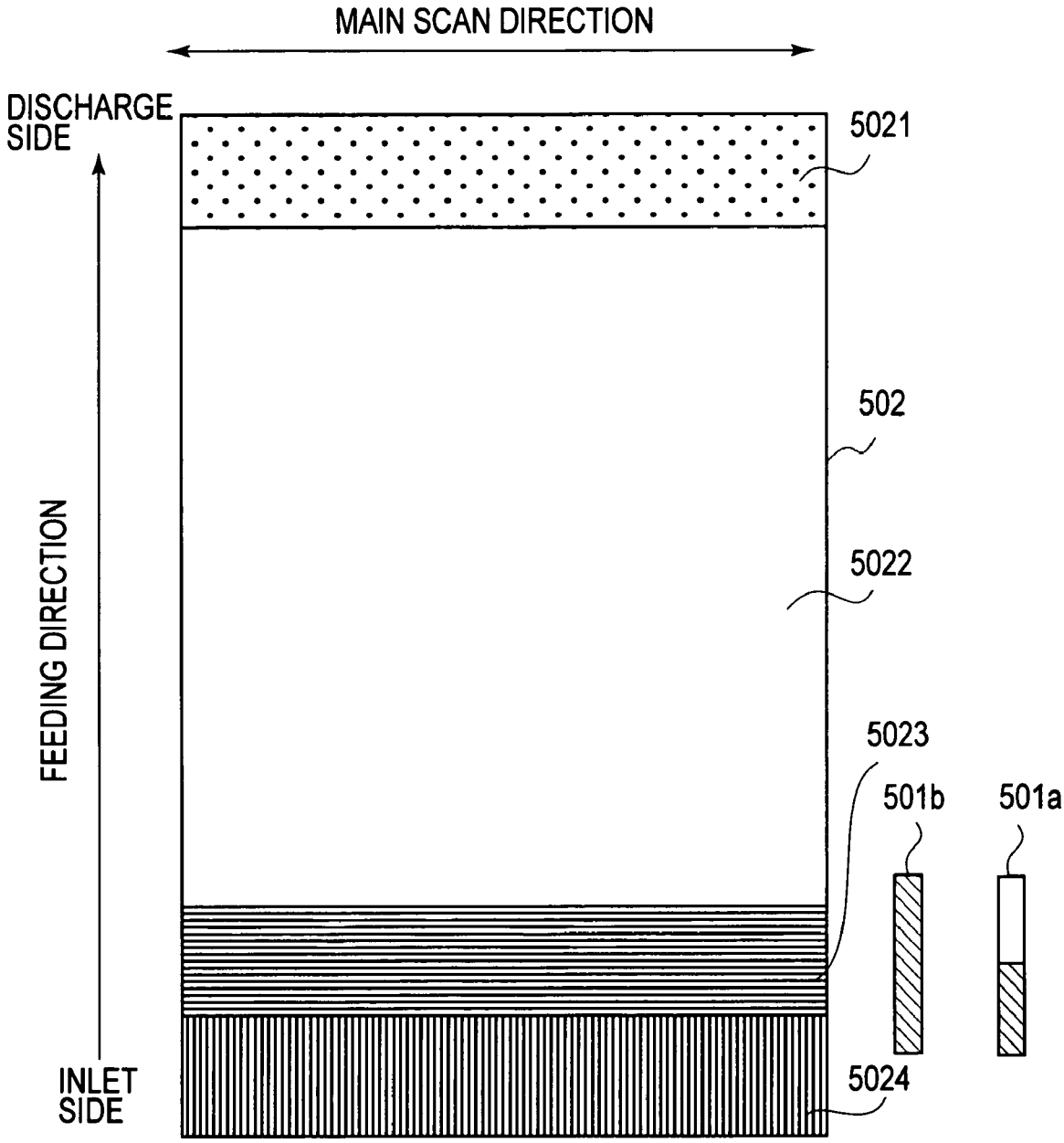

FIG. 6 shows nozzles used for recording in the recording area located between the ordinary recording area and the trailing end portion recording area.

When the recording material is fed by the feeding roller and the discharge roller and then the feeding operation is performed only the discharge roller immediately at the instance when the trailing end portion of the recording material leaves the feeding roller, the feeding rate is liable to become large, thus lowering the feeding accuracy. This is because the feeding roller cannot hold securely the recording material immediately before the instance when the recording material leaves the feeding roller, thus lowering the feeding accuracy. As a result of the lowering in feeding accuracy, a recorded image quality is also lowered.

Incidentally, such a phenomenon that the feeding rate of the recording material is increased when the recording material leaves the feeding roller is referred to as "kick, and the recording area 5023 before kick is caused to occur is also referred to as a kick-ready area in which one feeding operation is adapted to the kick and the state immediately before the instance when the recording material leaves the feeding roller in order to prevent occurrences of the kick and the state immediately before the instance when the recording material leaves the feeding roller. More specifically, the feeding rate is increased so as not to cause the state immediately before the instance when the recording material leaves the feeding roller and at the same time, a nozzle opening position in recording scanning is also switched. Such a series of operations including large feeding of the recording material at the trailing end portion of the recording material (on the upstream side of the feeding direction) and the switching of nozzle position used for recording is referred to as a "kick process".

In the kick-ready area 5023 shown in FIG. 6, as a preliminary step for performing the kick process, switching of nozzles is performed so that nozzles used in recording scanning are restricted to a part of the nozzles located on the inlet side and recording is performed by the restricted part of the nozzles on the inlet side until start of the kick process. More specifically, in the kick-ready area 5023, nozzles used for recording are switched from nozzles (of the recording material 501*b*) used for recording in the ordinary recording area 5022 to nozzles (of the recording head 501*a*) on the inlet side of the recording head so as to effect recording only by use of the nozzles on the inlet side. In this case, with respect to the nozzles of the recording head, when an operating state of almost all the nozzles (the recording head 501*b*) is changed to an operating state of only the nozzles on the inlet side of the recording head (the recording head 501*a*), the number of nozzles used for recording may be decreased gradually.

Figure 7:
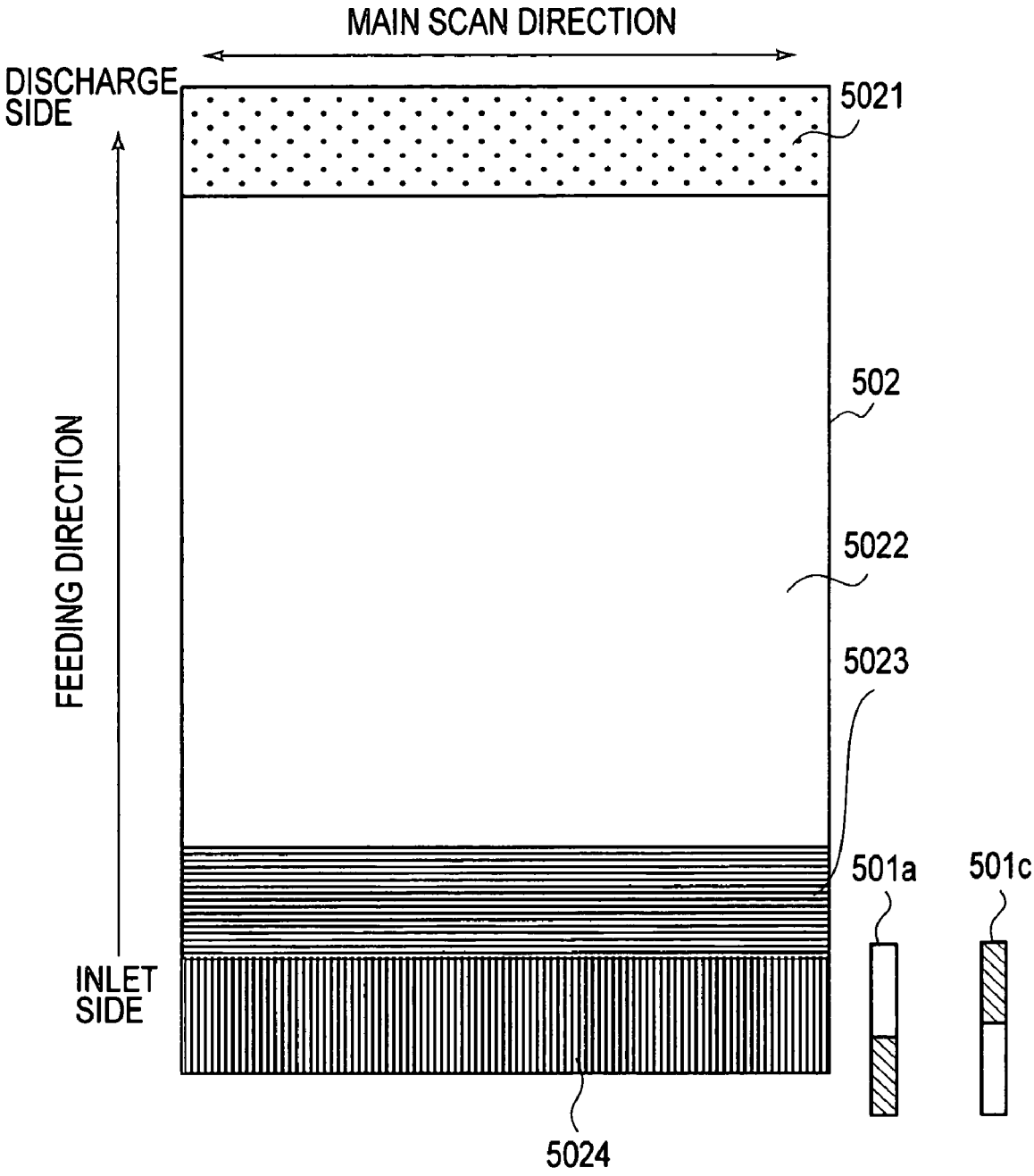

FIG. 7 shows nozzles used for recording at the trailing end portion of the recording material.

As shown by a recording head 501*a* in FIG. 7, in a trailing end portion recording area 5024 of the recording material, nozzles located on the inlet side are used to effect recording and then an operating position of the nozzles is shifted to the discharge side as in a recording head 501*c*. In the trailing end portion recording area 5024, the kick process is performed.

As described above, during the frame-less recording, the nozzles used for recording are selectively employed depending on a recording area of the recording material. In other words, the nozzles used for recording are changed for each of recording scannings in the leading end portion recording area, the kick-ready area, and the trailing end portion recording area of the recording material. Incidentally, in this embodiment, the kick-ready area and the trailing end portion recording area are described separately but may be inclusively employed as a trailing end portion recording area.

Figure 8:
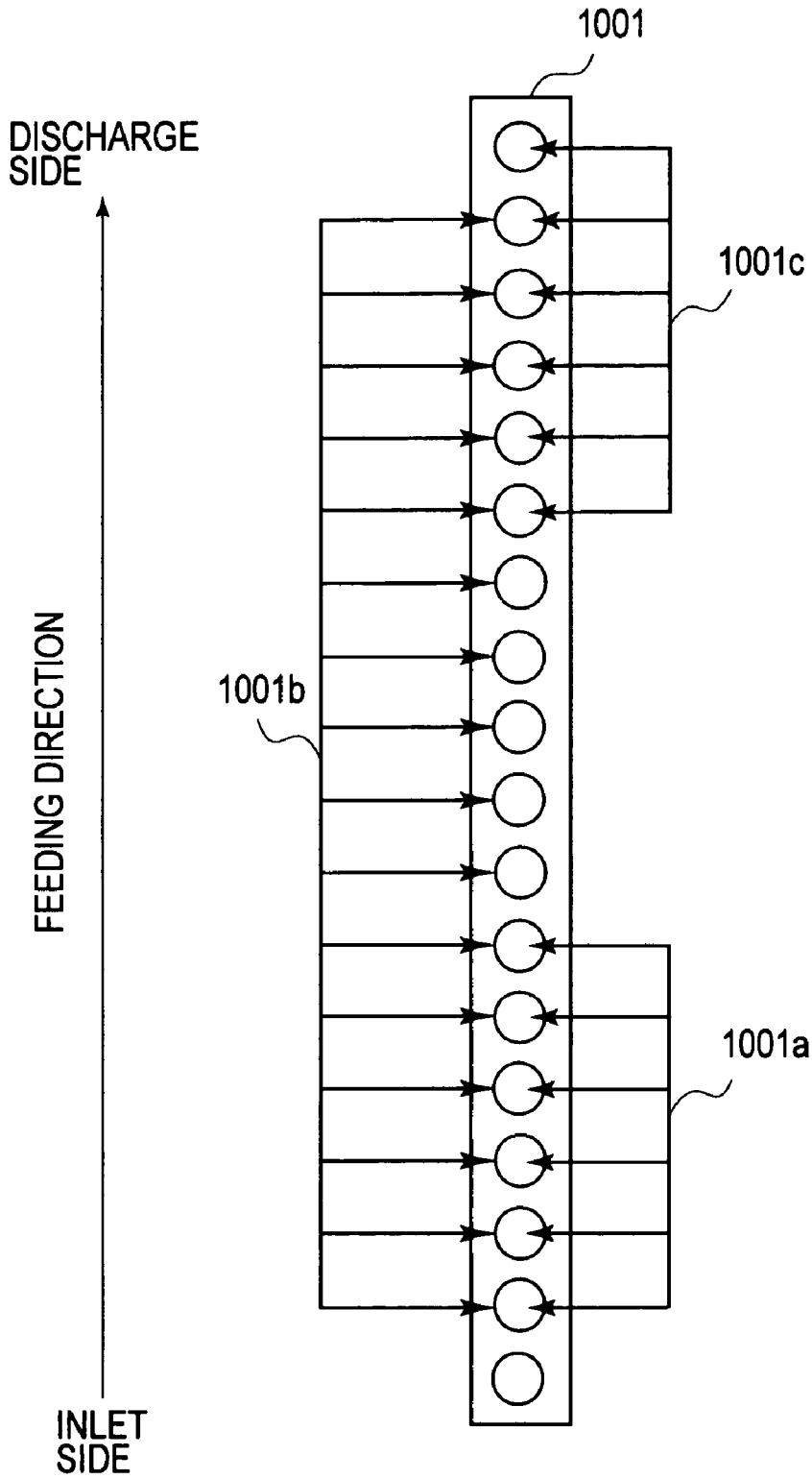
FIG. 8 is a schematic view showing an example of a nozzle structure for explaining First Embodiment of the present invention.

FIG. 8 shows an example of a positional relationship between operating nozzles during the frame-less recording.

Referring to FIG. 8, with respect to nozzles arranged in a recording material 1001, a nozzle operating position is that of nozzles 1001*a* in a leading end portion recording area and is that of nozzles 1001*b* in an ordinary recording area, and is switched from that of the nozzles 1001*a* to that of nozzles 1001*c*.

Next, a preliminary ejection control process in the above constituted recording apparatus will be described.

Figure 9A:
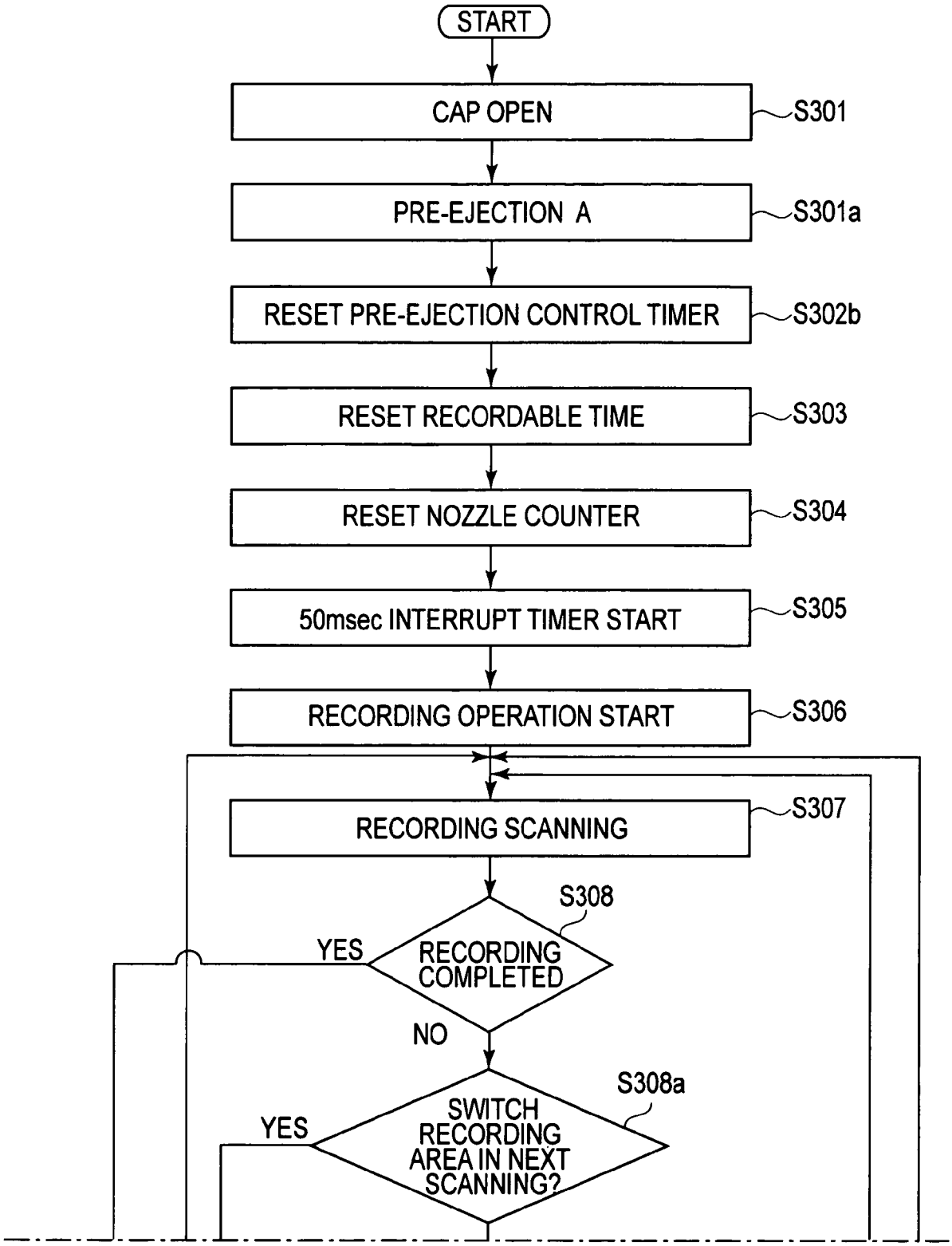
FIG. 9 (9A/9B) is a flow chart for explaining First Embodiment of the present invention.
Figure 9B:
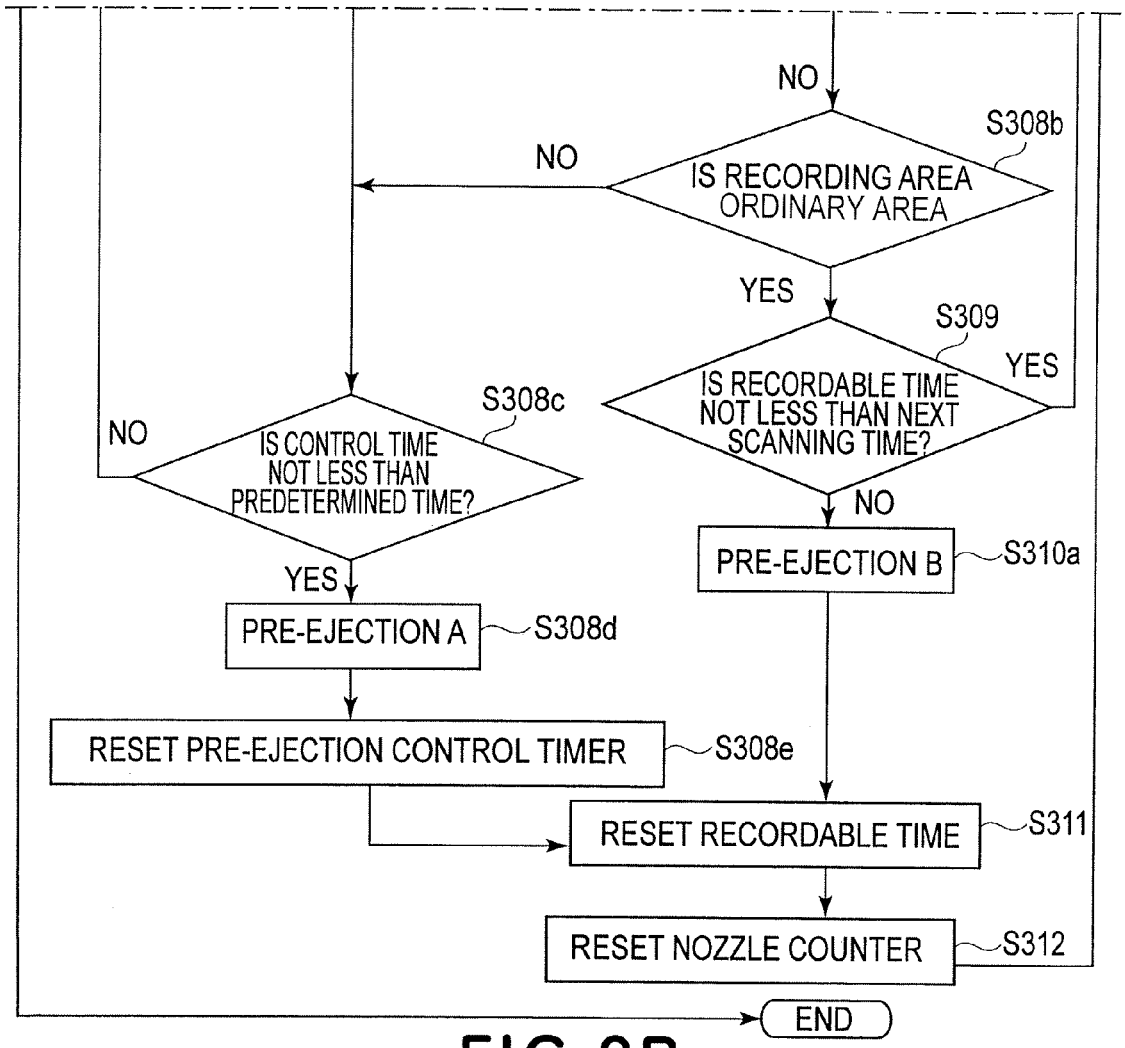
Figure 9:
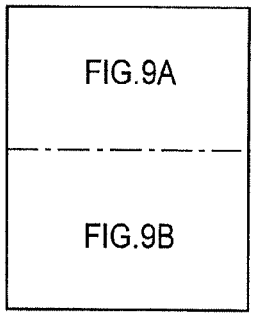

FIG. 9 (9A/9B) is a flow chart showing the preliminary ejection control process in this embodiment.

This process is performed in such a manner that the MPU 601 reads and executes a control program stored in the ROM 602.

First of all, in such a state that the recording apparatus 1 waits for recording data from the host apparatus (hereinafter, simply referred to as a "host") 610, ejection outlets of the recording head 3 are capped with the capping mechanism 11 at the home position in order to prevent evaporation of moisture (water content) and a solvent from the ejection outlets.

In this state, when the recording apparatus 1 receives the recording data from the host 610, the capping mechanism 11 is actuated to release the ejection outlet surface of the recording head 3 from the capped state in a step S301. By this operation, the cap is moved away from the recording head 3. In a subsequent step S302*a*, the preliminary ejection A is performed and in a step S302*b*, a preliminary ejection control timer (TPD) for performing the preliminary ejection A performed in the step S302*a* is performed by using all the nozzles irrespective of whether the nozzles are to be used in a subsequent recording scanning or not. The preliminary ejection control timer in the step S302*b* measures an elapsed time from the preliminary ejection A by automatically up-dating a time with the elapsed time.

Next, in a step S303, a recordable time (or a print enable period) (PENBL) is initialized (reset) to a predetermined value and in a step S304, counted values (Dcount (i), i=1, N) by a nozzle counter are initialized so that all the counted values become "0". In a step S305, an interrupt timer for creating timing to update the recordable time (PENBL) at a predetermined time period is actuated.

For example, in this embodiment, an interrupt time period (TINRT) is 50 msec. Further, N represents a number of recording elements, and the recordable time (PENBL) is a time (period) in which normal ink ejection from the recording head is expected and is determined on the basis of performances of the recording head and the recording apparatus.

Here, the interrupt process at a 50 msec-interval will be described with reference to FIG. 10. This interrupt process is performed irrespective of recording scanning so long as the recording head 3 is in such a state that it is not capped (cap-open state).

Figure 10:
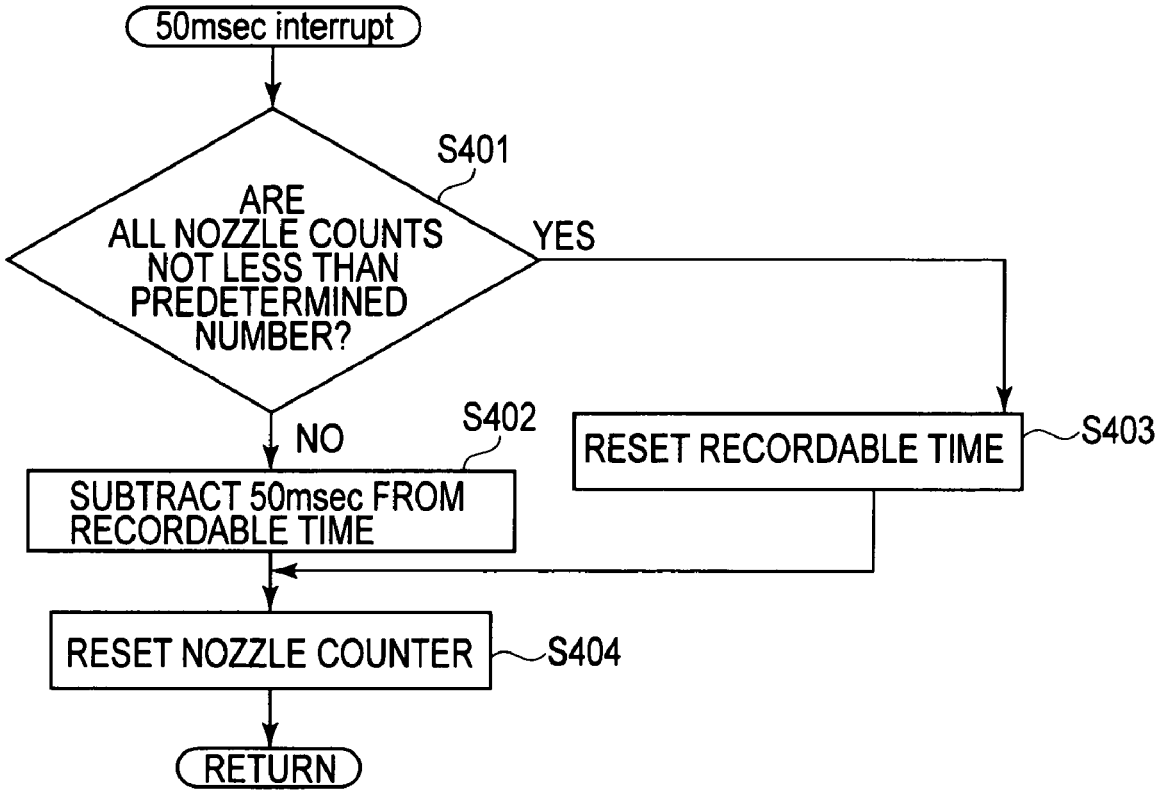
FIG. 10 is a flow chart showing an interrupt timer processing used in First Embodiment of the present invention.

FIG. 10 is a flow chart showing the interrupt process by the interrupt timer.

Referring to FIG. 10, in a first step S401, counted values (Dcount (i), i=1, N) by the nozzle counter are checked as to whether or not all the counted values reach a predetermined value (TH). In this embodiment, TH=3. With respect to all the counted values by the nozzle counter, when Dcount≧3 is satisfied, the process goes to a step S403 in which the recordable time (PENBL) is reset to effect initialization.

On the other hand, when Dcount<3 is satisfied with respect to any one of the counted values by the nozzle counter, the process goes to a step S402 in which the recordable time (PENBL) is updated as a new recordable time (PENBL) which is a value determined by subtracting 50 msec from the (previous) recordable time. After the process in the step S402 or S403, in a step S404, all the counted values (Dcount (i), i=N) by the nozzle counter is initialized to "0". As described above, the 50 msec-interval interrupt process is completed.

Again, with reference to FIG. 9, the preliminary ejection control process will be further described.

After a recording operation is started in a step S306, in a step S307, the recording head 3 is moved to effect recording scanning. At an interval between respective recording scannings, a moving speed of the recording head 3 is decreased, and then a movement direction is reversed and an accelerating control for a subsequent recording scanning is performed. Before one recording scanning is completed and the process goes to such a control that the moving speed of the recording head 3 is decreased, in a step S308, a check is made as to whether the recording is completed or not. When the recording is judged to be completed, the process is also completed as it is. When the recording is judged in the step S308 that it is not completed, the process goes to a step S308*a* in which a judgement is made as to whether or not switching of recording area is performed in a subsequent recording scanning. When the switching of recording area is performed, the process goes to a step S308*c*. When the recording area is judged in the step S308*a* that it is not switched in the subsequent recording scanning, the process goes to a step S308*b*. In the step S308*b*, a judgement is made as to whether or not the area in which the recording is performed is the ordinary recording area. In other words, in the step S308*b*, a judgement is made as to whether or not a position of operating nozzles is switched in the area, e.g., as in the leading end portion recording area. In the step S308*b*, when the area is judged that it is not the ordinary recording area, the process goes to a step S308*c*.

In the step S308*c*, a time indicated by the preliminary ejection control timer (TPD) is checked whether or not it is not less than a predetermined time (T0). In the step S308*c*, when the time of the preliminary ejection control timer is not less than the predetermined time, i.e., TPD≧T0, such a judgement that the preliminary ejection A is required is made. As a result, the process goes to a step S308*d* in which the preliminary ejection A is performed by moving the recording head 3 to a preliminary ejection position. Thereafter, the process goes to a step S308*e* in which a value of the preliminary ejection control timer (TPD) is initialized to "0", and then goes to a step S311. In the step S308*c*, when the time of the preliminary ejection control timer is less than the predetermined time, i.e., TPD>T0, such a judgement that the preliminary ejection A is not required is made, and the process is returned to the step S307. Incidentally, the predetermined time (T0) is a time (period) in which ejection of ink from nozzles of the recording head can be expected to be performed normally, and is determined on the basis of performances of the recording head and the recording apparatus and a composition of ink to be ejected. Further, the predetermined time (T0) and the recordable time (PENBL) may be determined for each of colors of ink mounted in the recording head.

On the other hand, in the step S308*b*, when the area is judged that it is the ordinary, the recordable time (PENBL) at that point of time is compared with a time (Tscan) required for a subsequent recording scanning in a step S309. In the step S309, when PENBL>Tscan is satisfied, a judgement that it is not necessary to perform the preliminary ejection is made and the process is returned to the step S307. However, when PENBL<Tscan is satisfied, a judgement that it is necessary to perform the preliminary ejection is made and the process goes to a step S310*a*. In the step S310*a*, the recording head 3 is moved to a preliminary ejection position at which the preliminary ejection B is performed and then the process goes to a step S311. In this embodiment, the preliminary ejection position is a capping position of the home position of the recording head 3. In this embodiment, similarly as in the preliminary ejection A, the preliminary ejection B is performed by ejecting ink from all the nozzles irrespective of whether or not they are nozzles to be used in a subsequent recording scanning. However, compared with the preliminary ejection A, the number of ink droplets ejected from each of the nozzles is set to be small. More specifically, in the preliminary ejection A, from each of the nozzles, 15 ink droplets are ejected. On the other hand, in the preliminary ejection B, from each of the nozzles, 2 ink droplets are ejected. The reason why the number of ejected ink droplets in the preliminary ejection B is larger than that in the preliminary ejection A is that the preliminary ejection A is performed every predetermined time interval, so that an amount of ink required for recovery until normal ejection becomes larger with a longer predetermined time interval.

In the step S311, the recordable time (PENBL) is initialized, and in step S312, all the counted values (Dcount (i), i=1, N) by the nozzle counter are initialized to "0". Thereafter, the process is returned to the step S307.

After the process is completed based on the judgement in the step S308, the recording apparatus waits for subsequent recording instructions for a certain period of time. When the recording instructions are not received even after the waiting of the certain period of time, the capping mechanism 11 is actuated so as to cap the recording head 3 by causing the cap to contact the recording head 3. On the other hand, when the recording instructions are received during the waiting, the process goes to the step S307 in which the recording scanning is started again.

As described above, according to the control process in this embodiment, depending on a recording area in which recording is performed by the recording head, a method of judging as to whether a condition for performing preliminary ejection is satisfied or not is changed. As a result, even when such a nozzle monitoring control that the preliminary ejection is effected on the basis of the number of ink droplets ejected from nozzle, it becomes possible to perform appropriate preliminary ejection to suppress a lowering in throughput. Accordingly, efficient and minimum required preliminary ejection is performed. Incidentally, as the method of judging as to whether or not the condition for performing the preliminary ejection is satisfied, it is possible to adopt a method of performing preliminary ejection on the basis of the number of ink droplet ejected from each of the nozzles and a method of performing preliminary ejection on the basis of an elapsed time from a previous preliminary ejection.

Incidentally, in the case where a plurality of nozzles of different types (e.g., different sizes of ejection outlets for ejecting ink) is provided in the recording material, a threshold for performing preliminary ejection may be set for each of the types of nozzles so as to permit normal ink ejection from each of nozzles of respective types. Further, in order to simplify the control of preliminary ejection, it is also possible to set a minimum threshold of those for the nozzles of respective types as a threshold for performing preliminary ejection with respect to all the nozzles. Herein, the threshold may include the recordable time (PENBL), a threshold to be compared with counted values counted by the nozzle counter, and a time to be compared with a value (time) of the preliminary ejection control timer. Further, the nozzles may be divided into those counted by the nozzle counter and those which are not counted by the nozzle counter.

In this embodiment, the control process for performing preliminary ejection is changed for each of the respective recording areas but discrimination between the recording areas is made on the basis of the feeding rate of the recording material by the feeding mechanism. This is because the recording data received by the recording apparatus also include information on the size of the recording material, so that it is possible to effect discrimination as to which area of the recording material is subjected to recording by calculating the feeding rate by the recording apparatus.

As described above, according to this embodiment, by changing the control process during the preliminary ejection between the ordinary recording area in which the nozzles used for recording are switched and other recording areas in which the nozzles used for recording are switched, it becomes possible to effect the preliminary ejection in any recording area at an appropriate frequency. More specifically, in this embodiment, the preliminary ejection performed by the nozzle monitoring control and the preliminary ejection performed every predetermined time interval are selectively effected depending on whether or not the recording area is a recording area in which the nozzles used for recording are switched every recording scanning, whereby it becomes possible to perform an appropriate preliminary ejection operation. In addition, it is also possible to improve throughput and reduce ink consumption during the preliminary ejection. Incidentally, in this embodiment, as an example of the recording in which the nozzles used are switched, the frame-less recording is described. However, e.g., when a feeding accuracy is lowered in the case of forming an image at an end portion of the recording material while leaving a small amount of margin, it is possible to effect a recording method similarly as in the case of the above described frame-less recording.

Further, in this embodiment, during the recording in the ordinary recording area 5022, the nozzles used are not changed. However, several nozzles of the nozzles used for recording are switched in some cases. THis is caused to occur due to specifications of a feeding system. More specifically, a plurality of feeding operations slightly different in feeding rate are performed as one unit operation, so that several nozzles of the nozzles used for recording are switched depending on the feeding rate. In such cases, the recording area may be judged as the leading or trailing end portion recording area (the recording areas 5021, 5023 and 5024) when a number of nozzles, used for recording, switched between a previous recording scanning and a current recording scanning is not less than a predetermined number and may be judged as the ordinary recording area when the number of nozzles is less than the predetermined number.

Second Embodiment

In First Embodiment, discrimination between the preliminary ejection A performed through the preliminary ejection control timer and the preliminary ejection B performed through the nozzle monitoring control is made depending on whether the recording area is the ordinary recording area or not.

In this embodiment, in the step S308*b* shown in FIG. 9 (9B), judgement is made as to whether or not an operating nozzle position is switched in a subsequent recording scanning. When the nozzle position is switched, the process goes to the step S308*c*, and when the nozzle position is not switched, the process goes to the step S309.

By doing so, it is possible to increase a recording area in which the nozzle monitoring control is effected. As a result, it becomes possible to realize a more efficient preliminary ejection control.

In the present invention, description is made with respect to the case of the frame-less recording, the recording area is divided into plural areas as shown in FIGS. 4 to 7. However, also in such a case where a recording operation including only the kick treatment performed at the trailing end portion of the recording material is effected, similar effects as in the above described embodiments can be attained.

Further, the recording apparatus according to the present invention may include an image output terminal which is integrally or separately provided for information processing equipment such as a computer; a copying apparatus used in combination with a reader or the like; and a facsimile apparatus having a transmit/receive function.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 053237/2004 filed Feb. 27, 2004, which is hereby incorporated by reference.

What is claimed is:

1. A recording apparatus for effecting recording on a recording material by scanning the recording material with a recording head for ejecting ink from a plurality of nozzles, comprising:

feeding means for feeding the recording material;

discrimination means for discriminating whether a recording area, on which recording on the recording material fed by said feeding means is effected with the recording head, is a leading end portion of the recording material or a trailing end portion of the recording material;

preliminary ejection means for ejecting ink, which is not contributable to image recording, from each of the plurality of nozzles; and preliminary ejection control means for controlling said preliminary ejection means so that either a first preliminary ejection for performing preliminary ejection on the basis of the number of ejections of ink ejected from each of the plurality of nozzles is performed in the case where a discrimination result by said discrimination means is that the recording area is neither the leading end portion of the recording material nor the trailing end portion of the recording material, or a second preliminary ejection for performing preliminary ejection when an elapsed time from a previous second preliminary ejection exceeds a predetermined time is performed in the case where the discrimination result by said discrimination means is that the recording area is the leading end portion of the recording material or the trailing end portion of the recording material.

2. The apparatus according to claim 1, wherein said discrimination means discriminates the recording area of the recording material depending on whether or not a nozzle used for recording in a previous recording scanning with the recording head is different from a nozzle used for recording in a recording scanning subsequent to the previous recording scanning.

3. The apparatus according to claim 1, wherein said discrimination means discriminates the recording area of the recording material on the basis of a feeding rate of the recording material.

4. The apparatus according to claim 1, wherein said preliminary ejection control means controls said preliminary ejection means so that the second preliminary ejection is performed when the recording area is a recording area located at a leading end or a trailing end of the recording material and so that the first preliminary ejection is performed when the recording area is a recording area located between those at the leading end and the trailing end of the recording material.

5. The apparatus according to claim 1, wherein said apparatus further comprises:

counting means for counting the number of ejections of ink ejected from each of the plurality of nozzles during recording scanning by scanning with the recording head;

judgement means for judging as to whether or not the number of ejections counted by said counting means reaches a prescribed number;

adjusting means for adjusting a recordable time of the plurality of nozzles on the basis of a judgement result of said judgement means; and comparison means for comparing the recordable time adjusted by said adjusting means with a time required for a subsequent recording scanning for each completion of one recording scanning by the recording head, wherein said preliminary ejection control means controls said preliminary ejection means so that the first preliminary ejection is performed on the basis of a comparison result by said comparison means.

6. The apparatus according to claim 5, further comprising scanning means for effecting reciprocating scanning with the recording head, wherein said comparison means effects comparison when a movement direction of the recording head moved by said scanning means is reversed.

7. The apparatus according to claim 5, wherein the recordable time is a time when ink is expected to be ejected normally from the recording head and is reset to a predetermined initial value in advance of start of the recording scanning and when preliminary ejection is performed by said preliminary ejection means controlled by said preliminary ejection control means.

8. The apparatus according to claim 7, wherein said adjusting means shortens the recordable time by a predetermined time and resets a value counted by said counting means when the number of ejections of ink, ejected from all the plurality of nozzles, counted by said counting means does not reach a predetermined number of ejections of ink.

9. The apparatus according to claim 1, further comprising:

timer means for timing an elapsed time from the second preliminary ejection; and comparison means for comparing the elapsed time timed by said timer means with a predetermined time, wherein said preliminary ejection control means controls said preliminary ejection means so that the second preliminary ejection is performed on the basis of a comparison result by said comparison means.

10. The apparatus according to claim 9, wherein the predetermined time is a time when ink is expected to be ejected normally from the recording head and is reset to a predetermined initial value when the second preliminary ejection is performed.

11. The apparatus according to claim 1, wherein said preliminary ejection means moves the recording head to a predetermined position when preliminary ejection is performed by the recording head.

12. The apparatus according to claim 11, wherein the predetermined position is a home position of the recording head.

13. The apparatus according to claim 12, further comprising, at the home position of the recording material, capping means for capping an ink ejection surface of the recording material, wiping means for wiping the ink ejection surface, and suction means for sucking ink from the recording head.

14. A preliminary ejection control method in a recording apparatus comprising a recording head for ejecting ink from a plurality of nozzles and preliminary ejection means for ejecting ink, which is not contributable to image recording, from each of the plurality of nozzles, and effects recording on a recording material by scanning the recording material with the recording head, said method comprising:

a discrimination step for discriminating whether a recording area, on which recording on the recording material fed by feeding means is effected with the recording head, is a leading end portion of the recording material or a trailing end portion of the recording material; and a preliminary ejection control step for controlling the preliminary ejection means so that either one of a first preliminary ejection for performing preliminary ejection on the basis of the number of ejections of ink ejected from each of the plurality of nozzles and a second preliminary ejection for performing preliminary ejection on the basis of an elapsed time from a previous preliminary ejection is performed on the basis of a discrimination result in said discrimination step, wherein in said preliminary ejection control step, the preliminary ejection means is controlled so that the first preliminary ejection is performed in the case where a discrimination result by said discrimination step is that the recording area is neither the leading end portion of the recording material nor the trailing end portion of the recording material, and the second preliminary ejection is performed when the elapsed time exceeds a predetermined time in the case where the discrimination result by said discrimination step is that the recording area is the leading end portion of the recording material or the trailing end portion of the recording material.

15. The method according to claim 14, wherein said discrimination step discriminates the recording area of the recording material depending on whether or not a nozzle used for recording in a previous recording scanning with the recording head is different from a nozzle used for recording in a recording scanning subsequent to the previous recording scanning.

16. The method according to claim 14, wherein said discrimination step discriminates the recording area of the recording material on the basis of a feeding rate of the recording material.

17. The method according to claim 14, wherein said preliminary ejection control step controls the preliminary ejection means so that the second preliminary ejection is performed when the recording area is a recording area located at a leading end or a trailing end of the recording material and so that the first preliminary ejection is performed when the recording area is a recording area located between those at the leading end and the trailing end of the recording material.

18. The method according to claim 14, wherein before said preliminary ejection control step, said method further comprises:

a counting step for counting the number of ejections of ink ejected from each of the plurality of nozzles during recording scanning by scanning with the recording head;

a judgement step for judging as to whether or not the number of ejections counted in said counting step reaches a prescribed number;

an adjusting step for adjusting a recordable time of the plurality of nozzles on the basis of a judgement result of said judgement step; and a comparison step for comparing the recordable time adjusted in said adjusting step with a time required for a subsequent recording scanning for each completion of one recording scanning by the recording head, wherein in said preliminary ejection control step, the first preliminary ejection is performed on the basis of a comparison result in said comparison step.

19. The method according to claim 14, wherein before said preliminary ejection control step, said method further comprises:

a timer step for timing an elapsed time from the second preliminary ejection; and a comparison step for comparing the elapsed time timed in said timer step with a predetermined time, wherein in said preliminary ejection control step, the second preliminary ejection is performed on the basis of a comparison result in said comparison step.

20. A preliminary ejection control method in a recording apparatus comprising a recording head for ejecting ink from a plurality of nozzles and preliminary ejection means for ejecting ink, which is not contributable to image recording, from each of the plurality of nozzles, and effects recording on a recording material by scanning the recording material with the recording head, said method comprising:

a discrimination step for discriminating as to whether or not a nozzle used for recording in a previous recording scanning and a nozzle used for recording in a current recording scanning are different from each other; and a preliminary ejection control step for effecting control so that a first preliminary ejection for performing preliminary ejection on the basis of the number of ejections of ink ejected from each of the plurality of nozzles is performed when nozzles used for recording in a current recording scanning are identical to nozzles used for recording in a previous recording scanning and that a second preliminary ejection for performing preliminary ejection when an elapsed time from a previous second preliminary ejection exceeds a predetermined time is performed in the case where nozzles used for recording in a current recording scanning are judged as being different from nozzles used for recording in a previous recording scanning.

* * * * *